US007775288B2

(12) United States Patent
Hickie

(10) Patent No.: US 7,775,288 B2
(45) Date of Patent: Aug. 17, 2010

(54) RETRIEVABLE FRAC MANDREL AND WELL CONTROL STACK TO FACILITATE WELL COMPLETION, RE-COMPLETION OR WORKOVER AND METHOD OF USE

(75) Inventor: Barton E. Hickie, Oklahoma City, OK (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 497 days.

(21) Appl. No.: 11/544,975

(22) Filed: Oct. 6, 2006

(65) Prior Publication Data

US 2008/0083539 A1 Apr. 10, 2008

(51) Int. Cl.
*E21B 19/00* (2006.01)

(52) U.S. Cl. ..... 166/379; 166/75.13; 166/90.1

(58) Field of Classification Search ..... 166/379, 166/90.1, 88.1, 85.1, 96.1, 75.13, 97.1; 285/918, 285/275, 276, 145.2, 90
See application file for complete search history.

(56) References Cited

U.S. PATENT DOCUMENTS 2,150,887 A * 3/1939 Mueller et al. ..... 166/379
3,391,735 A 7/1968 Schramm et al.
4,076,079 A 2/1978 Herricks et al.
4,552,213 A * 11/1985 Boyd et al. ..... 166/88.4
5,012,865 A 5/1991 McLeod
5,285,852 A 2/1994 McLeod
5,332,044 A 7/1994 Dallas et al.
5,372,202 A 12/1994 Dallas
5,785,121 A 7/1998 Dallas
5,819,851 A 10/1998 Dallas
5,975,211 A 11/1999 Harris
6,015,014 A 1/2000 Macleod et al.
6,019,175 A 2/2000 Haynes
6,039,120 A 3/2000 Wilkins et al.
6,220,363 B1 4/2001 Dallas
6,247,537 B1 6/2001 Dallas
6,289,993 B1 9/2001 Dallas
6,364,024 B1 4/2002 Dallas
6,557,629 B2 5/2003 Wong et al.
6,712,147 B2 3/2004 Dallas
6,769,489 B2 8/2004 Dallas
6,817,421 B2 11/2004 Dallas
6,817,423 B2 11/2004 Dallas
6,823,942 B1 * 11/2004 McGee ..... 166/379
6,920,925 B2 7/2005 Duhn et al.
7,040,410 B2 5/2006 McGuire et al.
7,055,623 B2 * 6/2006 Calderoni et al. ..... 175/6
7,055,632 B2 6/2006 Dallas
7,066,269 B2 6/2006 Dallas et al.
7,159,652 B2 1/2007 McGuire et al.

(Continued)

*Primary Examiner*—Jennifer H Gay
*Assistant Examiner*—Cathleen R Hutchins
(74) *Attorney, Agent, or Firm*—Nelson Mullins Riley & Scarborough, LLP

(57) ABSTRACT

A retrievable frac mandrel and a well control stack are used to efficiently accomplish well completion, re-completion or workover. The retrievable frac mandrel is inserted in a tubing head spool of a well to be completed, re-completed or re-worked. The well control stack is mounted to a top of the tubing head spool and seals off against a top of the retrievable frac mandrel. Once well completion, re-completion or workover is completed, the frac mandrel can be retrieved from the tubing head spool without killing or plugging the well.

19 Claims, 21 Drawing Sheets

U.S. PATENT DOCUMENTS

| | | | | |
|---|---|---|---|---|
| 7,159,663 | B2 | 1/2007 | McGuire et al. | |
| 7,207,384 | B2 | 4/2007 | Dallas et al. | |
| D546,665 | S | 7/2007 | Medlin | |
| 7,237,615 | B2 | 7/2007 | Dallas et al. | |
| 7,308,934 | B2 | 12/2007 | Swagerty et al. | |
| 7,322,407 | B2 | 1/2008 | Duhn et al. | |
| 2003/0221823 | A1* | 12/2003 | Duhn et al. | 166/85.4 |
| 2004/0154790 | A1* | 8/2004 | Cornelssen et al. | 166/75.13 |
| 2005/0092496 | A1 | 5/2005 | Duhn et al. | |
| 2005/0211442 | A1 | 9/2005 | McGuire et al. | |
| 2006/0060349 | A1 | 3/2006 | Duhn et al. | |
| 2006/0185841 | A1* | 8/2006 | Swagerty et al. | 166/88.1 |
| 2006/0196677 | A1 | 9/2006 | McGuire et al. | |
| 2007/0267198 | A1* | 11/2007 | McGuire | 166/379 |

* cited by examiner

RETRIEVABLE FRAC MANDREL AND WELL CONTROL STACK TO FACILITATE WELL COMPLETION, RE-COMPLETION OR WORKOVER AND METHOD OF USE

FIELD OF THE INVENTION

This invention relates in general to hydrocarbon well completion, re-completion or workover and, in particular, to a retrievable frac mandrel and a well control stack, and a method of using the frac mandrel and the well control stack to facilitate well completion, re-completion or workover.

BACKGROUND OF THE INVENTION

It is well understood that attempts to maintain viable hydrocarbon supplies have necessitated the exploitation of more marginal hydrocarbon production zones. It is also well known that exploiting marginal hydrocarbon production zones requires the use of sophisticated well drilling techniques, such as horizontal drilling and multi-stage well completions. It is further known that marginal production zones generally require stimulation in order to be viable producers of hydrocarbons. As understood by those skilled in the art, the stimulation of hydrocarbon production zones generally requires pumping high-pressure fluids into the zones. In order to accomplish this, pressure-sensitive wellhead equipment must be protected during the stimulation process.

Many wellhead isolation tools have been developed to protect sensitive wellhead equipment while high pressure stimulation fluids are pumped into subterranean formations. A high-pressure mandrel of the wellhead isolation tool, commonly referred to as a "frac mandrel" provides the pressure isolation through the wellhead. Some wellhead isolation tools also provide full-bore access to a casing of the well in order to permit downhole operations such as logging, perforating and plugging to be performed through the tools. However, prior art wellhead isolation tools have known disadvantages. For example, they are expensive to use due to labor costs associated with delivering and operating them; they cannot be removed from a live well; or they are known to "get stuck" in the wellhead making them difficult or impossible to remove without killing or plugging a casing of the well.

There therefore exists a need for a retrievable frac mandrel with a well control stack that can be left on a wellhead throughout a well completion, re-completion or workover, and that can be removed from the wellhead without killing the well or plugging the casing.

SUMMARY OF THE INVENTION

It is therefore an object of the invention to provide a retrievable frac mandrel with a well control stack that can be left on a wellhead throughout a well completion, re-completion or workover, and that can be removed from the wellhead without killing the well or plugging the casing.

The invention therefore provides a retrievable frac mandrel and well control stack for facilitating completion, re-completion or workover of a cased well having a wellhead with a tubing head spool, comprising: a frac mandrel having a top end and a bottom end, the bottom end being contoured to be received in the tubing head spool and to provide a high-pressure fluid seal with a seal bore located above a bit guide of the tubing head spool; a well control adapter that mounts to a top flange of the tubing head spool, the well control adapter including an axial seal bore that receives the top end of the frac mandrel to provide a high-pressure fluid seal around a periphery of the top end, and an axial passage that has a diameter smaller than an outer diameter of the top end of the frac mandrel but at least as large as an internal diameter of the frac mandrel; and flow control equipment mounted to a top flange of the well control adapter.

The invention further provides a method of performing a completion, re-completion or workover of a cased well having a wellhead with a tubing head spool, comprising: inserting a bottom end of a frac mandrel into the tubing head spool and locking the frac mandrel in the tubing head spool; mounting a well control stack to a top flange of the tubing head spool, the well control stack including a well control adapter with an axial seal bore that receives the top end of the frac mandrel to provide a high-pressure fluid seal around a periphery of the top end, and an axial passage that has a diameter smaller than an outer diameter of the top end of the frac mandrel but at least as large as an internal diameter of the frac mandrel; mounting well completion, re-completion or workover equipment to a top of the well control stack; and performing a well completion, re-completion or workover operation using the equipment.

The invention yet further provides a retrievable frac mandrel for facilitating well completion, re-completion or workover of a cased well equipped with a wellhead with a tubing head spool, comprising: a bottom end contoured to be received in a central passage of the tubing head spool, the bottom end including a plurality of O-ring grooves with high pressure O-rings that seal off against a seal bore above a bit guide of the tubing head spool, and an annular groove engaged by lockdown screws of the tubing head spool to lock the frac mandrel in the tubing head spool; and a top end threadedly connected to the bottom end, the top end extending above a top of the tubing head spool.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a retrievable frac mandrel and a well control stack that are used for well completions, re-completions or workovers. The frac mandrel is received in a tubing head spool of a wellhead and locked in place using lockdown screws for securing a tubing hanger in the tubing head spool. A top of the frac mandrel projects above a top flange of the tubing head spool. The well control stack includes a well control adapter having a central passage that receives a top of the frac mandrel and provides a high-pressure fluid seal around it. A cross-flow tee is mounted to a top of the well control adapter, and a flow control device, such as a high-pressure valve or a blowout preventer is mounted to a top of the cross-flow tee. The frac mandrel and the well control stack permit full-bore access to a casing of the well, and enable any downhole operation to be performed. After a well is completed, re-completed or re-worked, the frac mandrel is plugged, the well control stack is removed and the frac mandrel is retrieved from the wellhead to permit the wellhead to be equipped for production.

Figure 1:
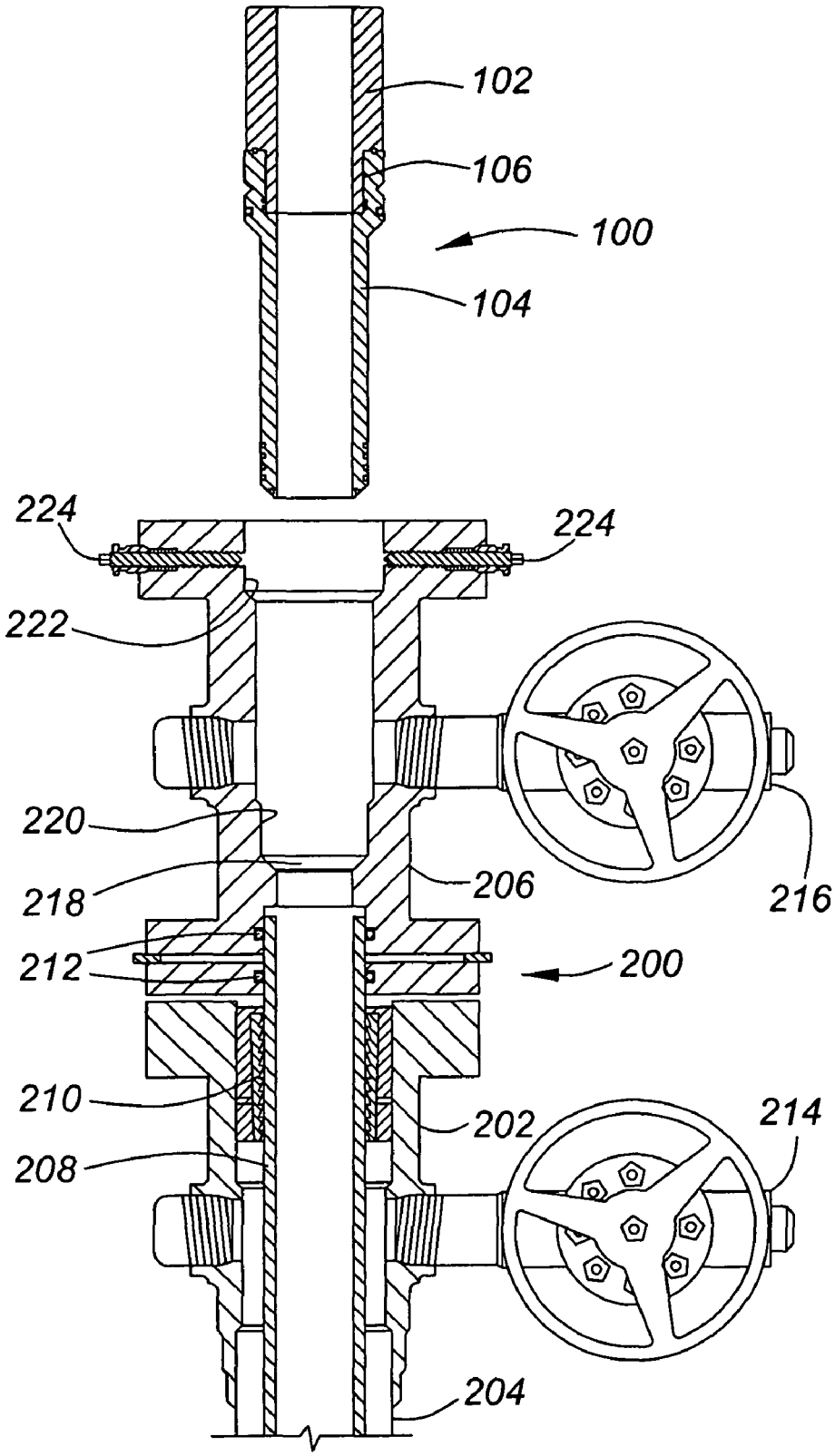
FIG. 1 is a schematic diagram of one embodiment of a retrievable frac mandrel in accordance with the invention suspended over a prior art wellhead.

FIG. 1 is a schematic cross-sectional diagram of a frac mandrel 100 in accordance with the invention suspended over a prior art wellhead 200. The frac mandrel 100 has a top end 102 and a bottom end 104. In one embodiment, the frac mandrel 100 is a two-piece mandrel having the top end 102 and the bottom end 104 threadedly connected by threads 106, as will be explained below in more detail with reference to FIG. 2.

The prior art wellhead 200 includes a tubing head spool 206 and a flanged surface casing spool 202 connected to a surface casing 204. Mounted to a top of the surface casing spool 202 is the tubing head spool 206. A production casing 208 is supported by casing slips 210. A top end of the production casing 208 is sealed by high-pressure seals 212 that have been up-graded to 10,000 psi. A side valve 214 controls fluid flow from an annulus of the surface casing 204. A side valve 216 controls fluid flow from the production casing 208. A bit guide 218 terminates a seal bore 220 in a bottom of the tubing head spool. A secondary seal bore 222 is located beneath lock down screws 224 that are used to lock a tubing hanger (not shown) in the tubing head spool 206.

Figure 2:
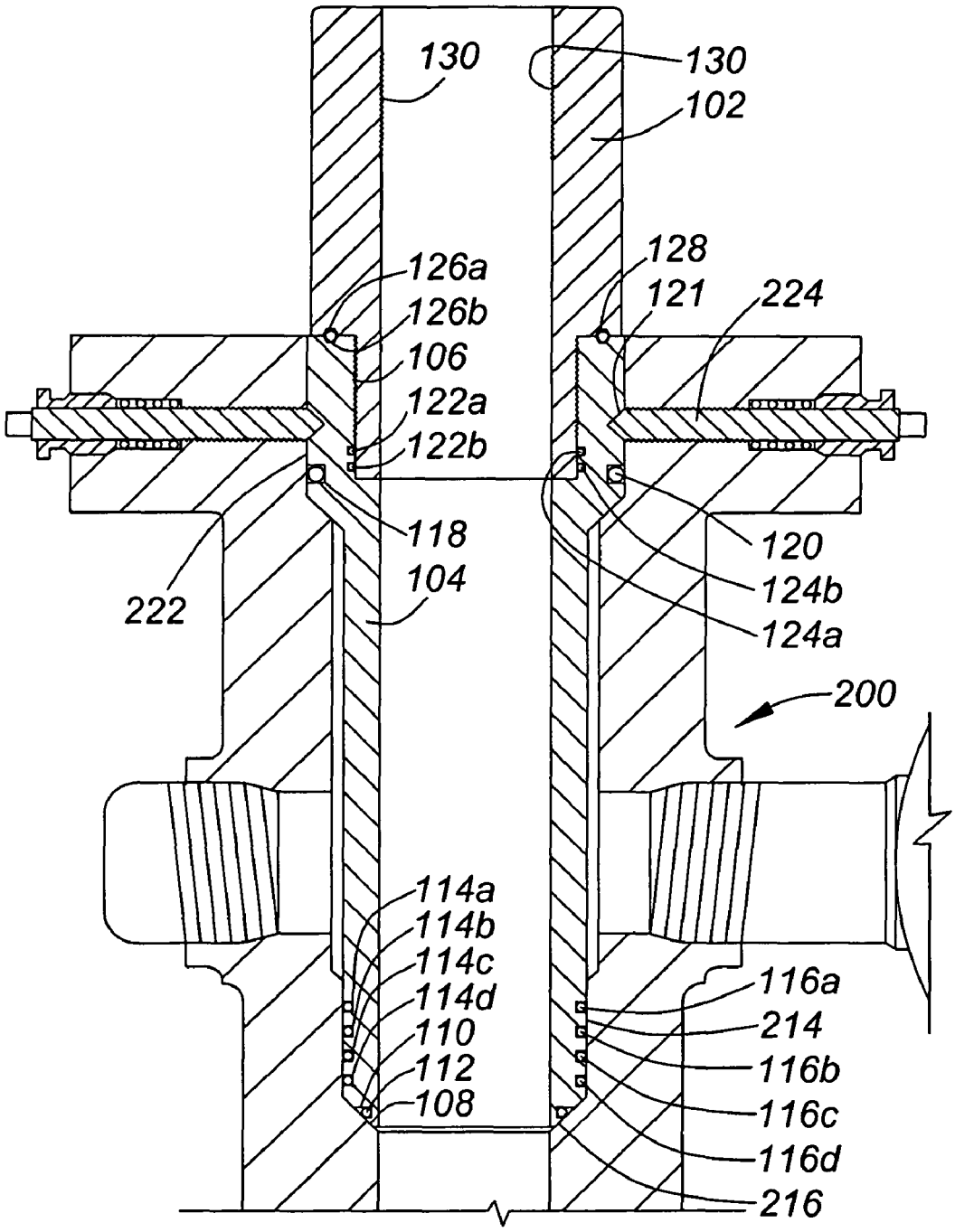
FIG. 2 is a schematic diagram of the frac mandrel shown in FIG. 1 mounted to the prior art wellhead.

FIG. 2 is a cross-sectional diagram of the frac mandrel 100 shown in FIG. 1 locked down in the prior art wellhead 200. The bottom end of 104 of the frac mandrel 100 is contoured to mate with the seal bore 214 and the bit guide 216. A bevel 108 on the bottom end 104 matches a bevel angle of the bit guide 216. An O-ring groove 110 receives a high-pressure O-ring 112 to inhibit the migration of well stimulation fluids between the bit guide 216 and the bevel 108 on the bottom end 104. The O-ring groove 110 and the O-ring 112 are optional. At least two O-rings provide a high-pressure fluid seal between the seal bore 220 and the bottom end 104 of the frac mandrel 100. In this embodiment, four O-ring grooves 114*a*-114*d* receive O-rings 116*a*-116*d* to provide the high-pressure seal. A further high-pressure seal is provided against the secondary seal bore 222 by an O-ring groove 118 that receives an O-ring 120. The frac mandrel 100 is locked in the wellhead 200, by the lock down screws 224, which engage a V-shaped annular groove 121 in the bottom end 104.

As explained above, the top end 102 is releasably connected to the bottom end 104 by threads 106, which include a box thread in the bottom end 104 and a mating pin thread on the top end 102. O-ring grooves 122*a*, 122*b* receive O-rings 124*a*, 124*b* for providing a fluid seal to prevent the migration of stimulation fluids into the threads 106. A backup seal is provided by a metal ring gasket 128 received in complementary metal ring gasket grooves 126*a*, 126*b*. The metal ring gasket 128 is a ring gasket of the type described in Applicant's United States patent application published on Apr. 21, 2005 under publication number 2005/0082829 A1, the specification of which is incorporated herein by reference. Back pressure threads 130 support a back pressure plug for sealing a central passage of the frac mandrel 100, as will be explained below with reference to FIG. 9. The two-piece frac mandrel 100 permits the top end 102 to be replaced if the back pressure threads 130 are damaged or "washed out".

Figure 3:
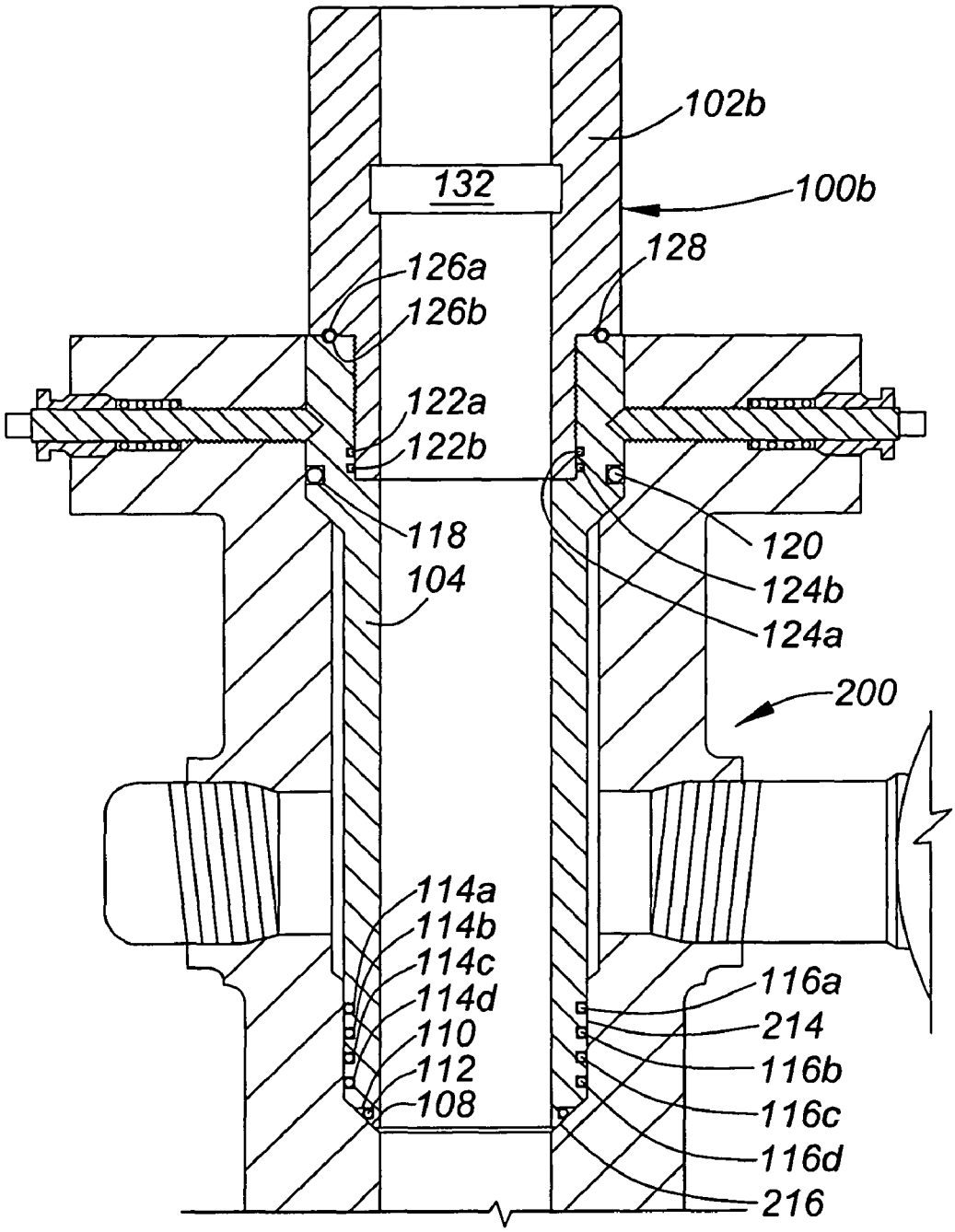
FIG. 3 is a schematic diagram of another embodiment of a frac mandrel in accordance with the invention mounted to the prior art wellhead.

FIG. 3 is a cross-sectional schematic diagram of another embodiment of the frac mandrel in accordance with the invention, generally indicated by number reference 100*b*. The frac mandrel 100*b* is identical to the frac mandrel 100 described above with reference to FIG. 2, with the exception that the back pressure threads 130 are replaced by an annular groove 132 machined in the internal passage through the top end 102*b*. The annular groove 132 provides a profile that may be gripped by a hydraulic shear-off tubing plug, as will be explained below with reference to FIG. 10.

Figure 4:
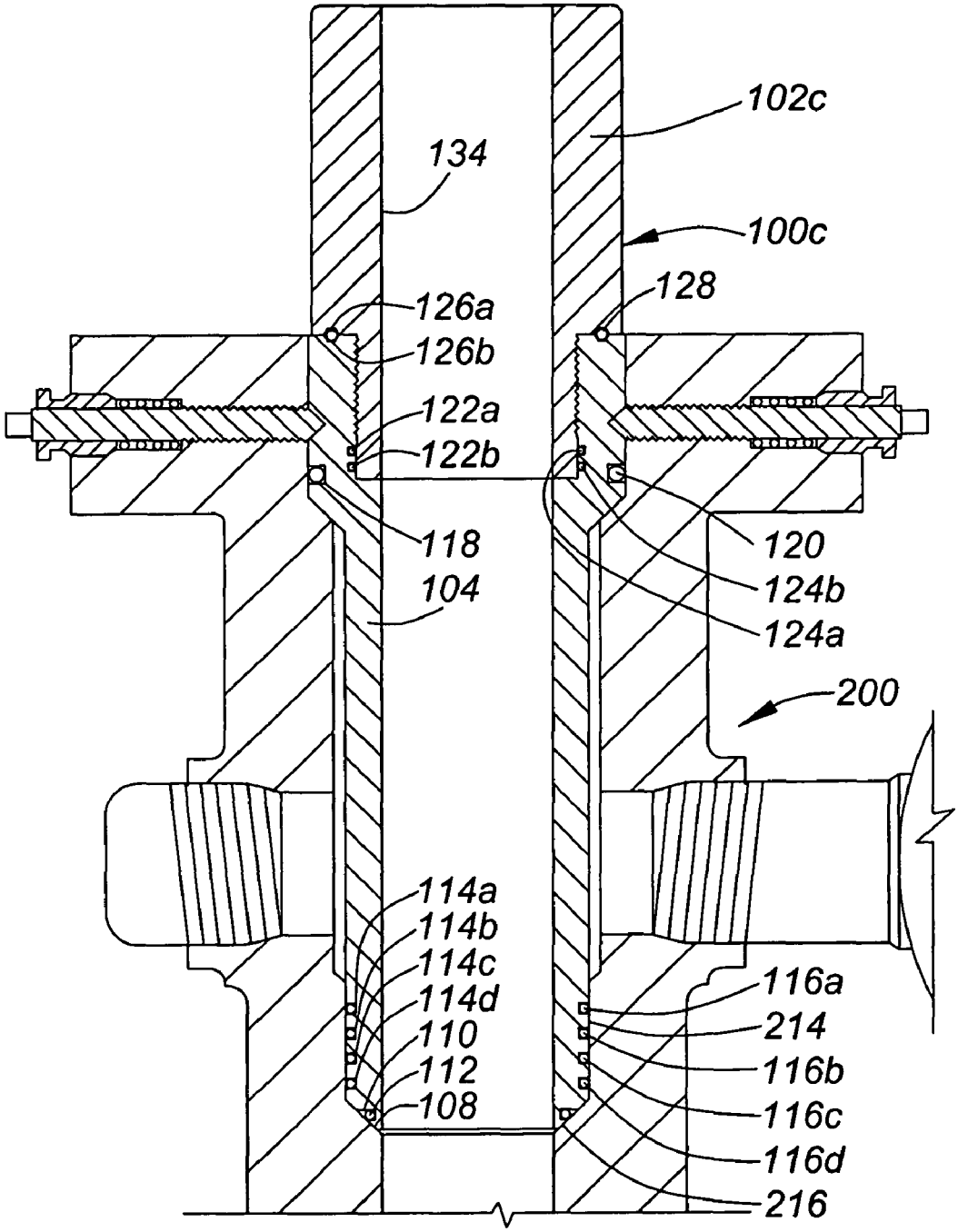
FIG. 4 is a schematic diagram of yet another embodiment of a frac mandrel in accordance with the invention mounted to the prior art wellhead.

FIG. 4 is a cross-sectional schematic diagram of yet another embodiment of the frac mandrel in accordance with the invention, generally indicated by reference number 100*c*. The frac mandrel 100*c* is identical to the frac mandrel 100 described above with reference to FIG. 2 with the exception that the top end of 102*c* has a smooth internal passage 134 that may be gripped using a through-tubing plug, as will be explained below with reference to FIG. 11.

Figure 5:
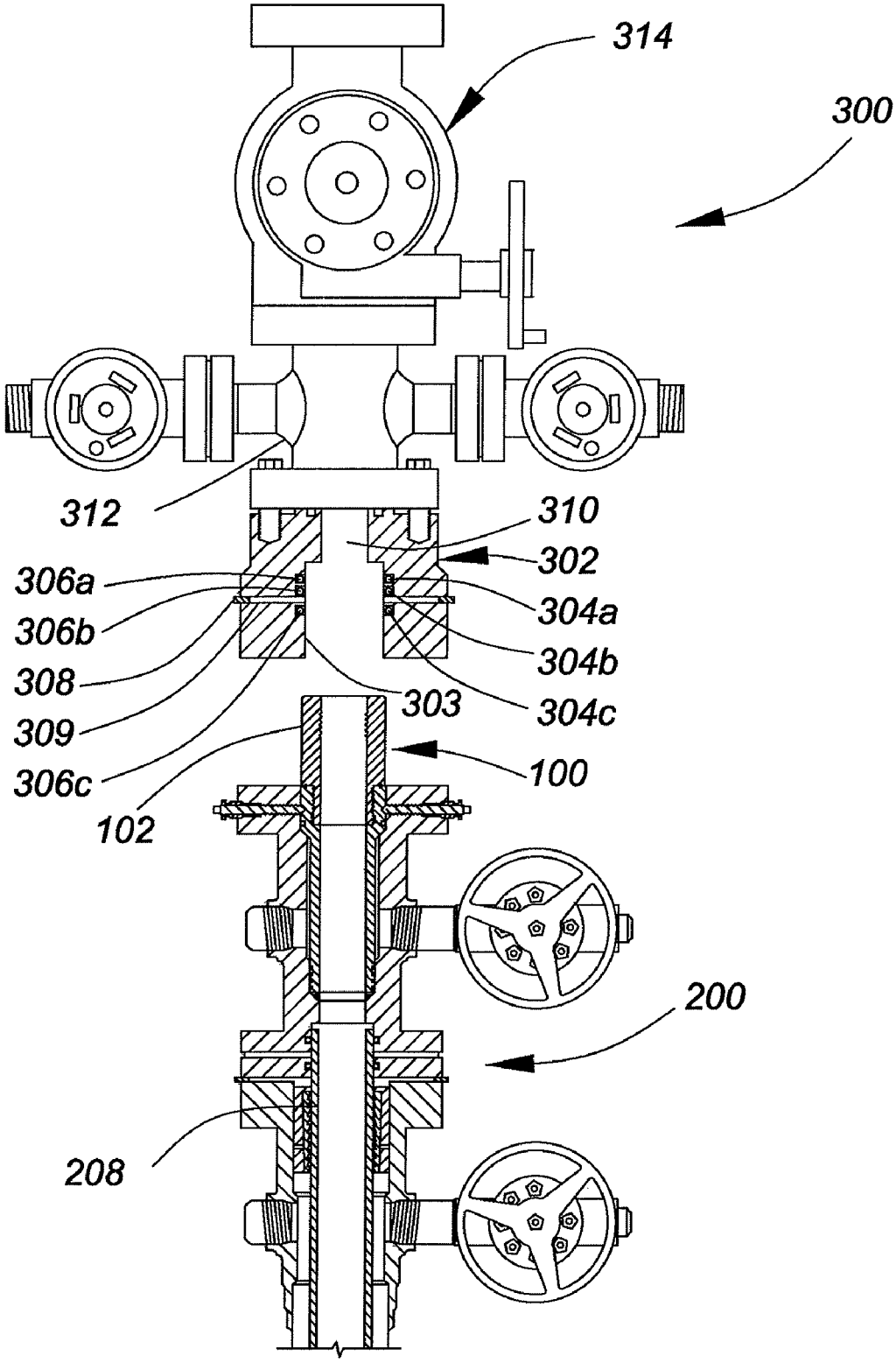
FIG. 5 is a schematic diagram of a well control stack in accordance the invention suspended over the wellhead shown in FIG. 2.

FIG. 5 is a schematic diagram of the frac mandrel 100 and the prior art wellhead 200 shown in FIG. 2, with a well control stack 300 suspended over a top of the frac mandrel 100. The well control stack 300 includes a well control adapter 302 having an axial seal bore 303 that receives the top end 102 of the frac mandrel 100. O-ring grooves 304*a*-304*c* receive O-rings 306*a*-306*c*, which provide a high-pressure fluid seal around a periphery of the top end 102 of the frac mandrel 100. Test port plugs 308 seal test bores 309 used to test an integrity of the high-pressure seals. An axial passage 310 in a top end of the well control adapter 302 has a diameter smaller than an outer diameter of the top end of the frac mandrel 100, but at least as large as an internal diameter of the central passage of the frac mandrel 100 and the production casing 208.

The well control stack 300 further includes flow control equipment, such as a cross-flow tee 312 used for pressure balancing and flow-back, and a pressure control spool, such as a high-pressure valve 314 or a blowout preventer (not shown).

Figure 6:
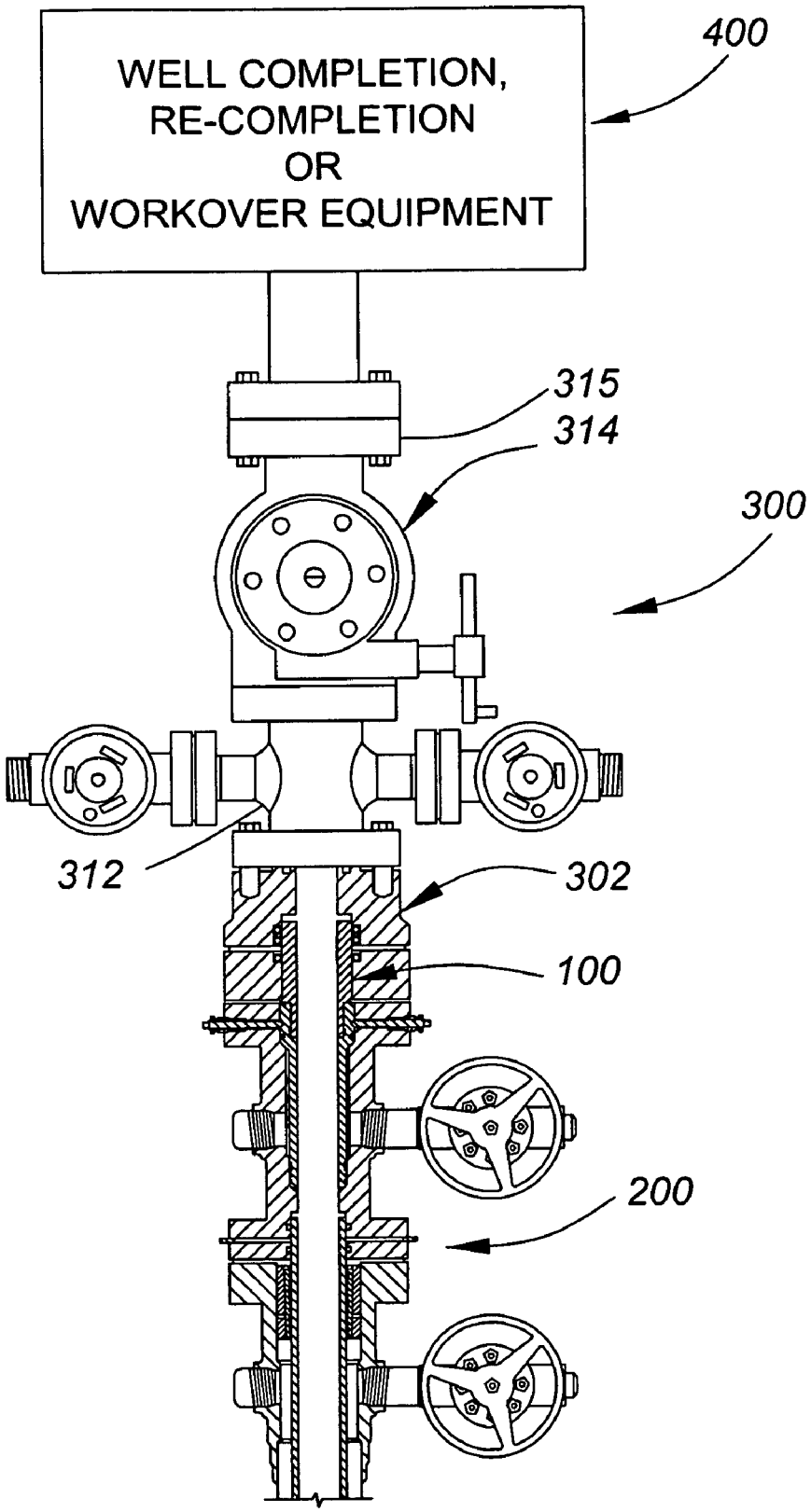
FIG. 6 is a schematic diagram of the well control stack shown in FIG. 4 mounted to the wellhead, with well completion, re-completion or workover equipment mounted to the well control stack.

FIG. 6 is a schematic diagram of the well control stack 300 mounted to a top of the prior art wellhead 200. Once the well control stack 300 has been mounted to the prior art wellhead 200, well completion, re-completion or workover equipment 400 can be mounted to a top of the high-pressure valve 314. The well completion, re-completion or workover equipment 400 may include any one or more of the following: a lubricator tube; a coil tubing injector; a wireline grease injector; a blowout preventer; a coil tubing blowout preventer; a wire line blowout preventer; a frac head; or any other tool required for well completion, re-completion or workover.

Figure 7:
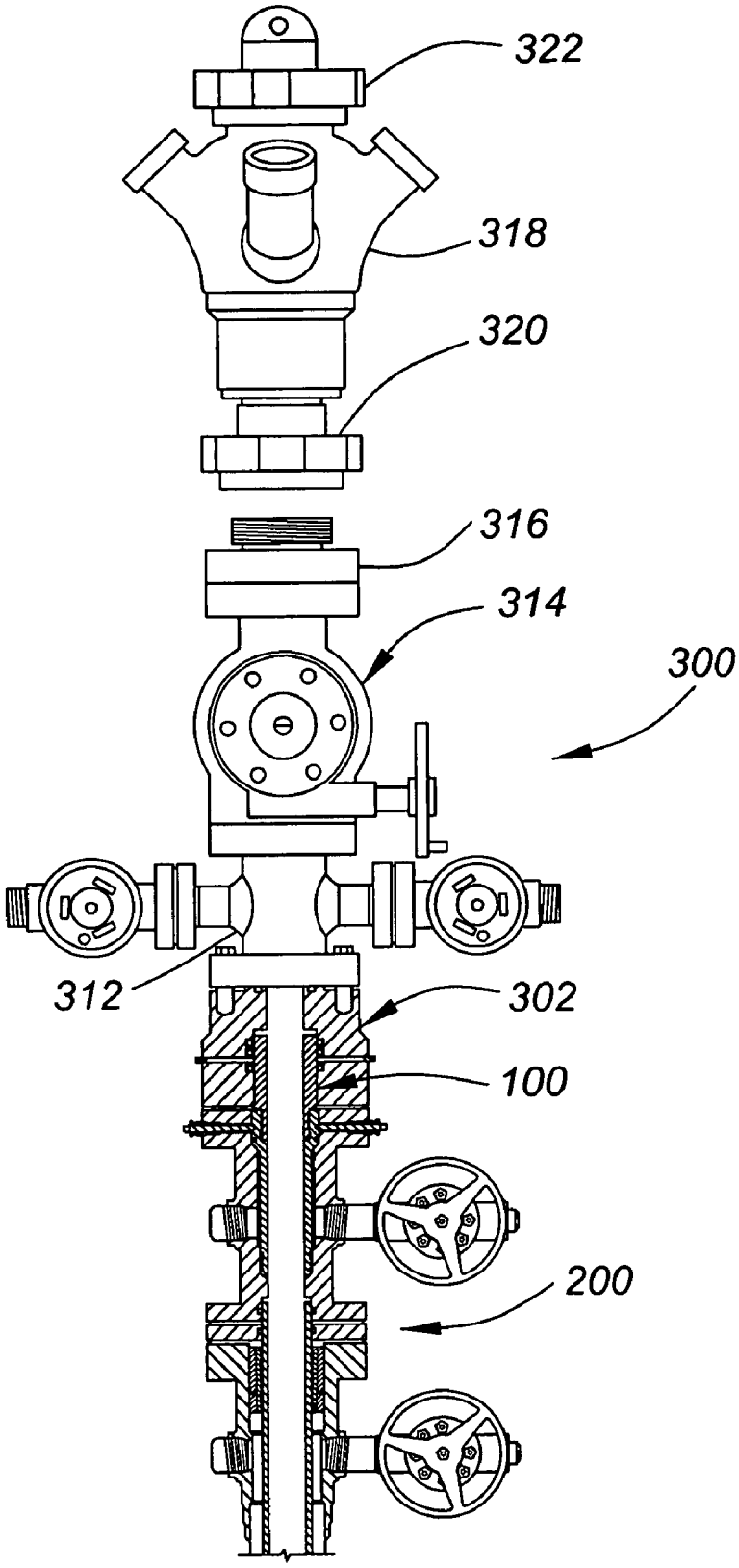
FIG. 7 is a schematic diagram of a frac head being mounted to the well control stack shown in FIG. 6.

FIG. 7 shows a frac head 318 supported by lifting sub 322 suspended over the well control stack 300. A threaded union adapter 316 is connected to a top of the high-pressure valve 314 and used to mount to the frac head 318 to the well control stack 300.

Figure 8:
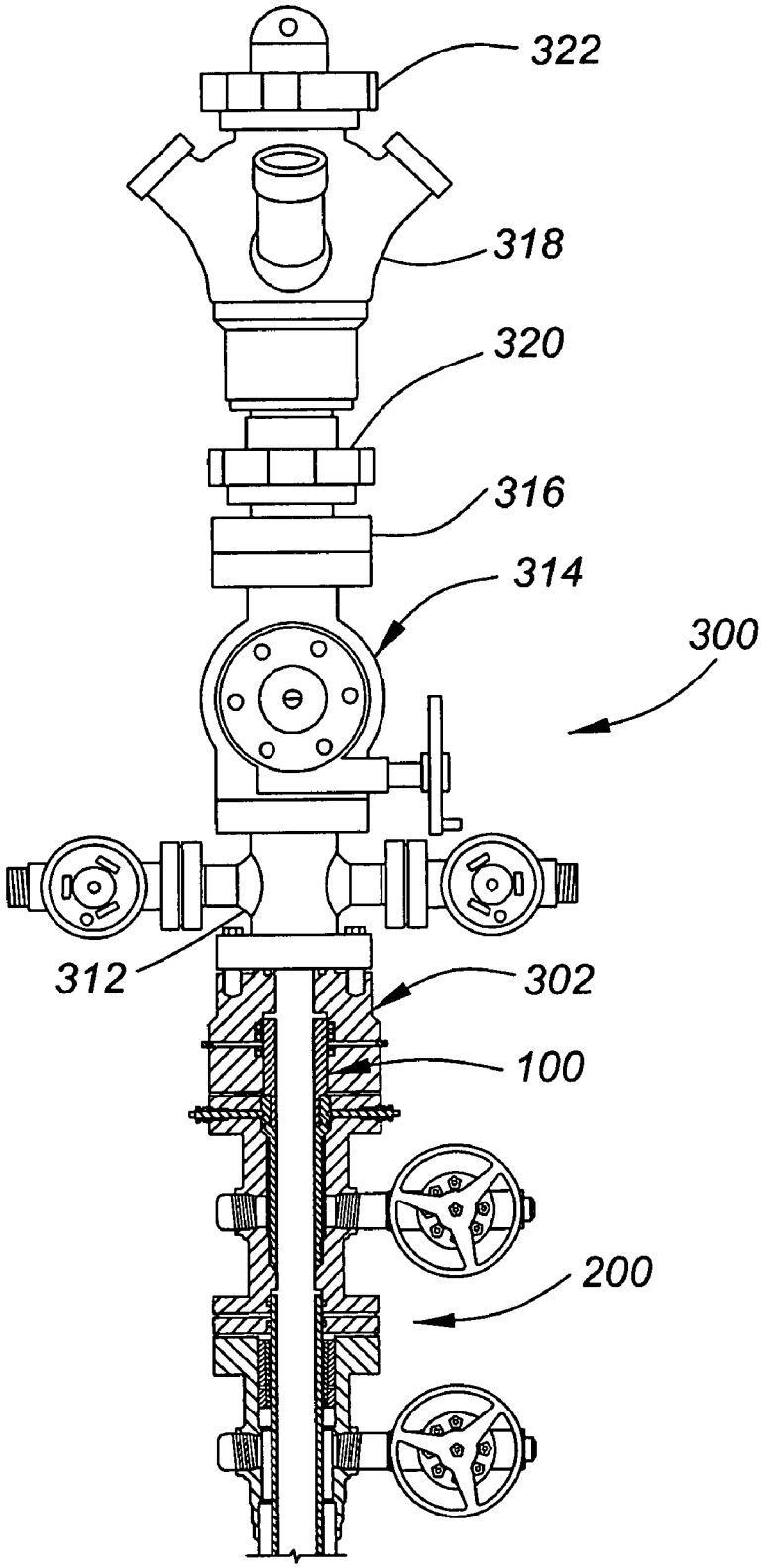
FIG. 8 is a schematic diagram of the frac head shown in FIG. 7 mounted to the well control stack.

FIG. 8 shows the frac head 318 after stimulation fluids have been pumped into the production casing 208, flowed back out of the wellbore and high pressure lines have been disconnected from the frac head 318. A lock down nut 320 secures the frac head 318 to the threaded union adapter 316. In this embodiment, the lock down nut 320 is a hammer nut well known in the art. The lock down nut 320 is released to remove the frac head 318 from the well control stack 300. As is well known in the art, stimulation of the well is generally a last step in any well completion, re-completion or workover. Consequently, after the stimulation fluids have been flowed back out of the well and the frac head 318 is removed, the well is ready to be equipped for production. However, in order to equip the well for production the well control stack 300 and the frac mandrel 100 must be removed from the wellhead 200.

Figure 9:
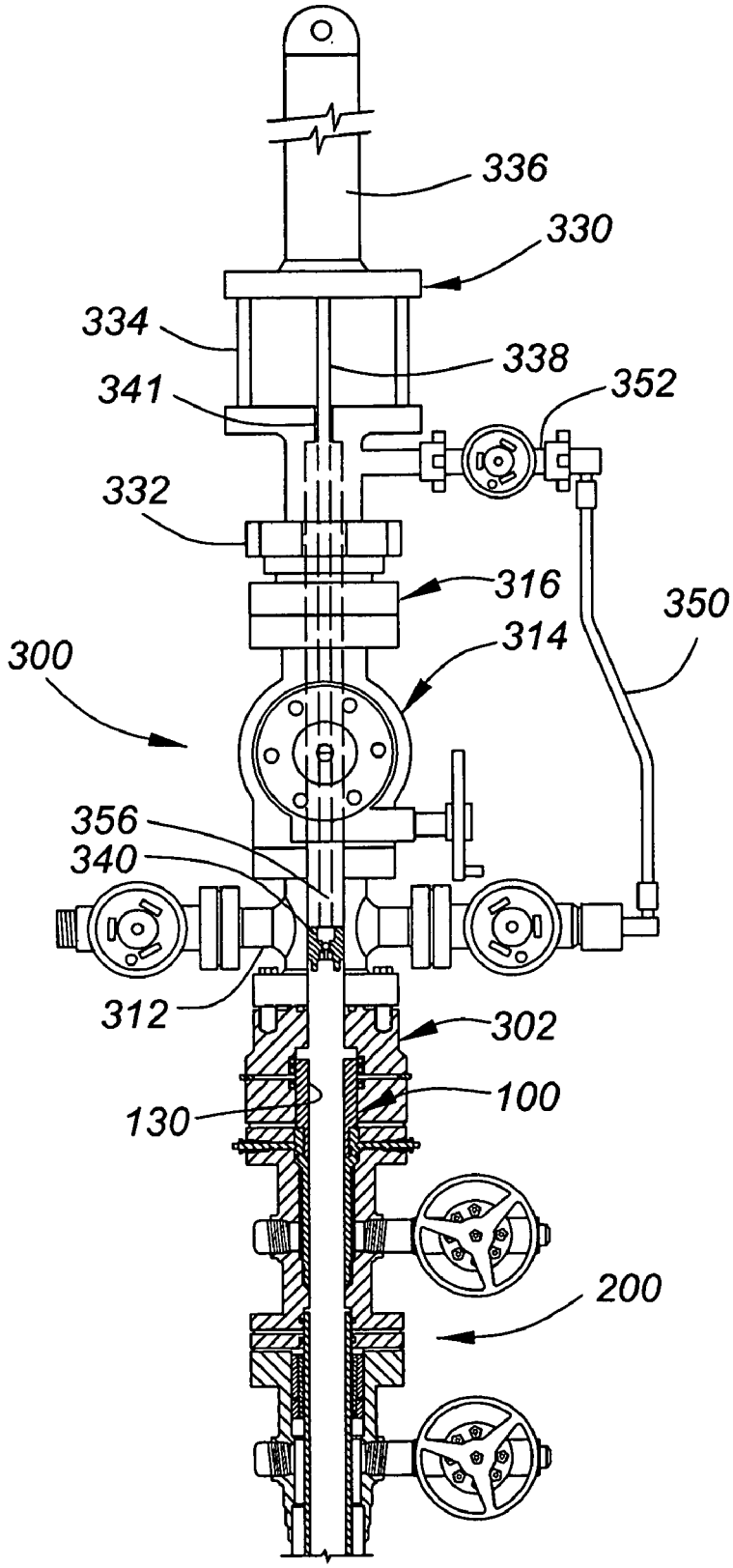
FIG. 9 is a schematic diagram of a back pressure plug tool mounted to the well control stack for setting a back pressure plug in the frac mandrel, to permit the well control stack to be removed from the wellhead.

Consequently, after the frac head 318 is removed from the well control stack 300 a prior art back pressure plug setting tool 330 schematically shown in FIG. 9 is mounted to the threaded union adapter 316 using a hammer nut 332. The back pressure plug setting tool 330 includes a hydraulic injector cylinder 336 supported by plurality of stay rods 334. A cylinder rod 338 of the injector cylinder 336 is connected to a back pressure setting tool adapter 356, which in turn connects to a back pressure plug 340. The cylinder rod 338 reciprocates through a stuffing box 341, which provides a high-pressure fluid seal around the cylinder rod 338. After the back pressure plug setting tool 330 is mounted to the well control stack 300, fluid pressure is balanced across the high-pressure valve 314 using a high-pressure line 350 connected to a pressure balance port 352 of the back pressure plug setting tool 330 in a manner well known in the art. The high-pressure valve 314 is then opened, and the back pressure plug 340 is stroked through the high-pressure valve as shown in FIG. 9.

Figure 10:
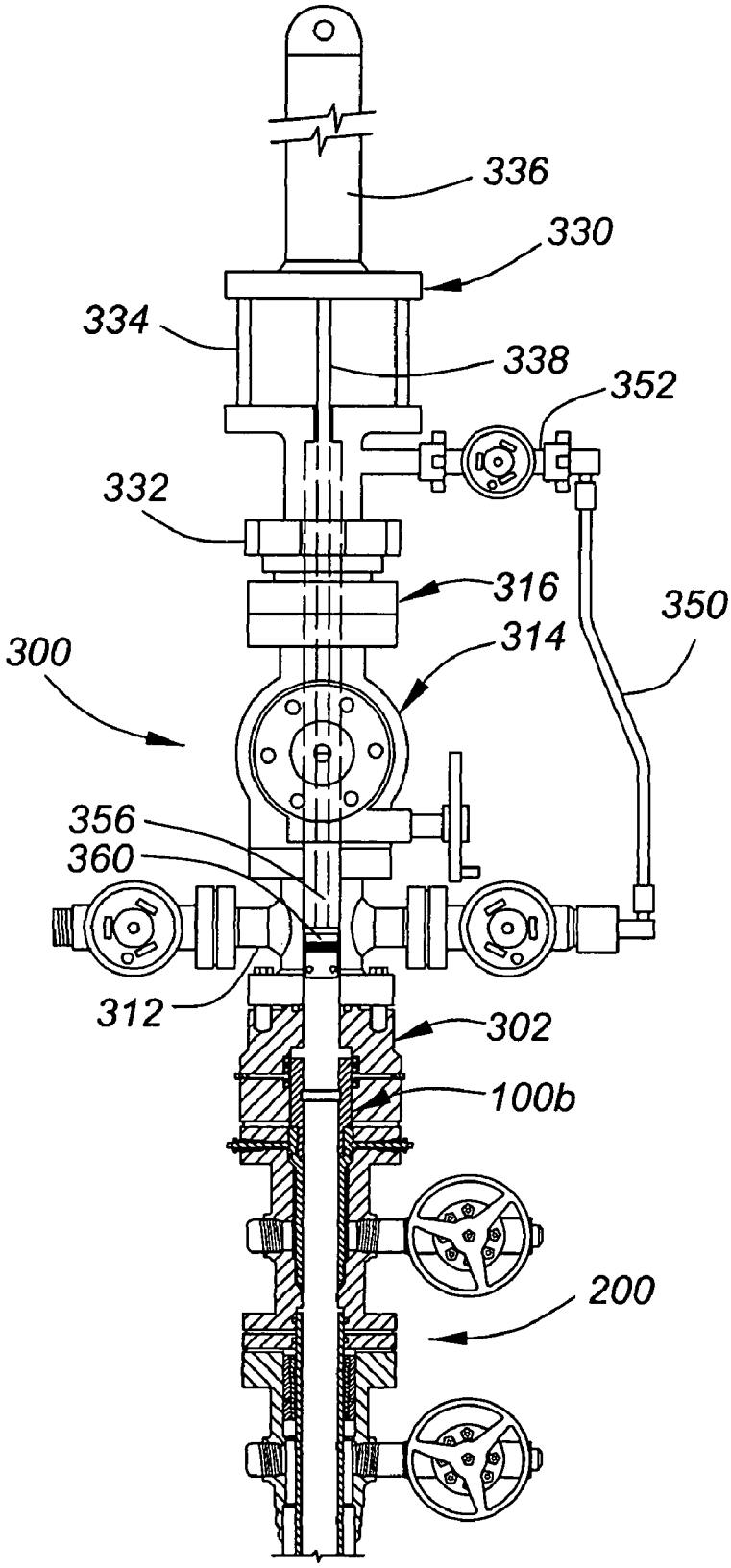
FIG. 10 is a schematic diagram of the back pressure plug tool mounted to the well control stack for setting a hydraulic shear-off tubing plug in the frac mandrel shown in FIG. 3, to permit the well control stack to be removed from the wellhead.

FIG. 10 is a schematic diagram of the back pressure plug setting tool 330 being used to set a hydraulic shear-off tubing plug 360. The hydraulic shear-off tubing plug 360 is used to plug the internal passage through the frac mandrel 100*b* shown in FIG. 3. The hydraulic shear-off tubing plug 360 engages the annular groove the 132 in the internal passage through the frac mandrel 100*b*.

Figure 11:
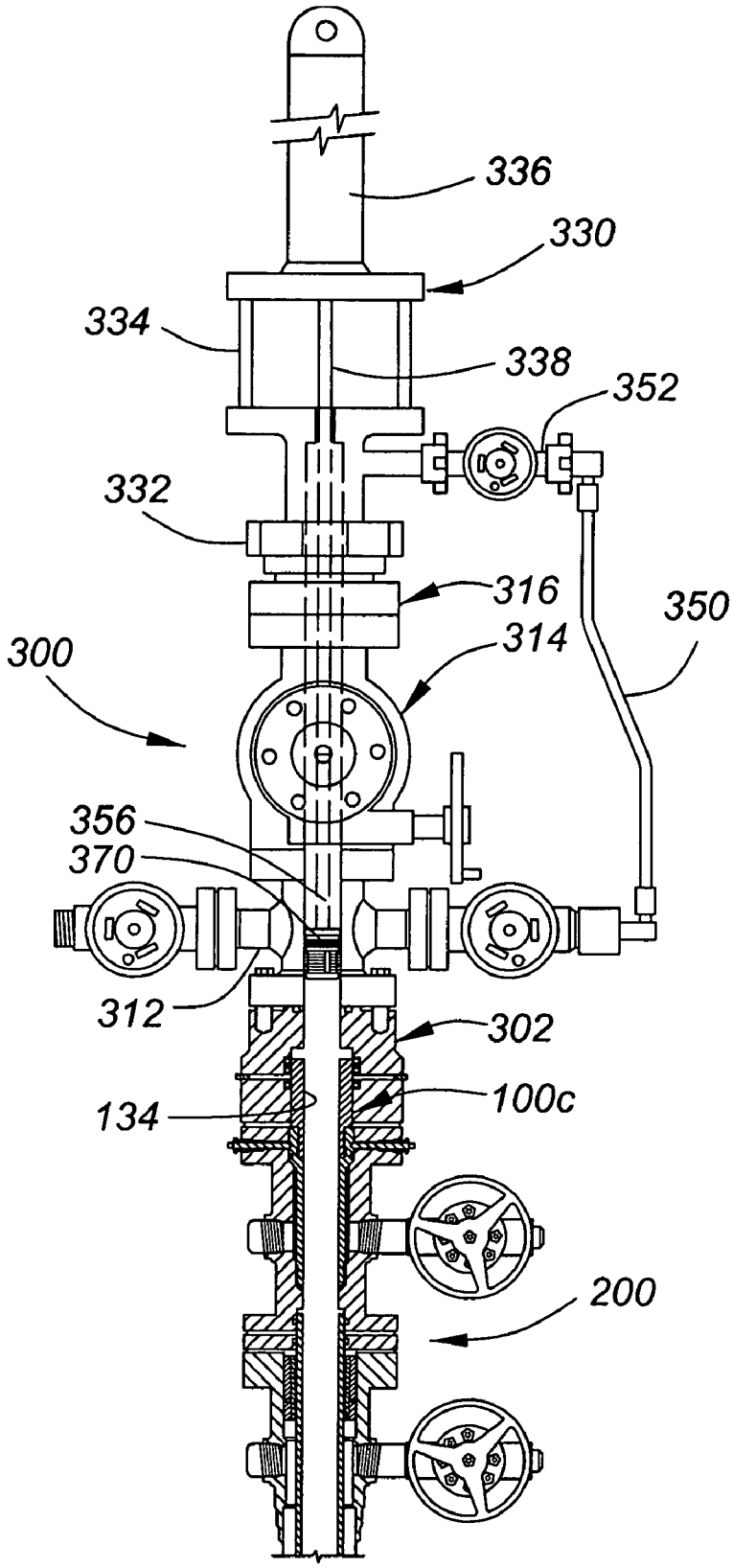
FIG. 11 is a schematic diagram of the back pressure plug tool mounted to the well control stack for setting a through-tubing plug in the frac mandrel shown in FIG. 4, to permit the well control stack to be removed from the wellhead.

FIG. 11 is a schematic diagram of the back pressure plug setting tool 330 being used to set a through-tubing plug 370 in the frac mandrel 100*c*. The through-tubing plug 360 is used to plug the internal passage 134 through the frac mandrel 100*c* shown in FIG. 4. The through-tubing plug 360 is, for example, a PosiSet® through-tubing plug manufactured by Schlumberger Corporation.

Figure 12:
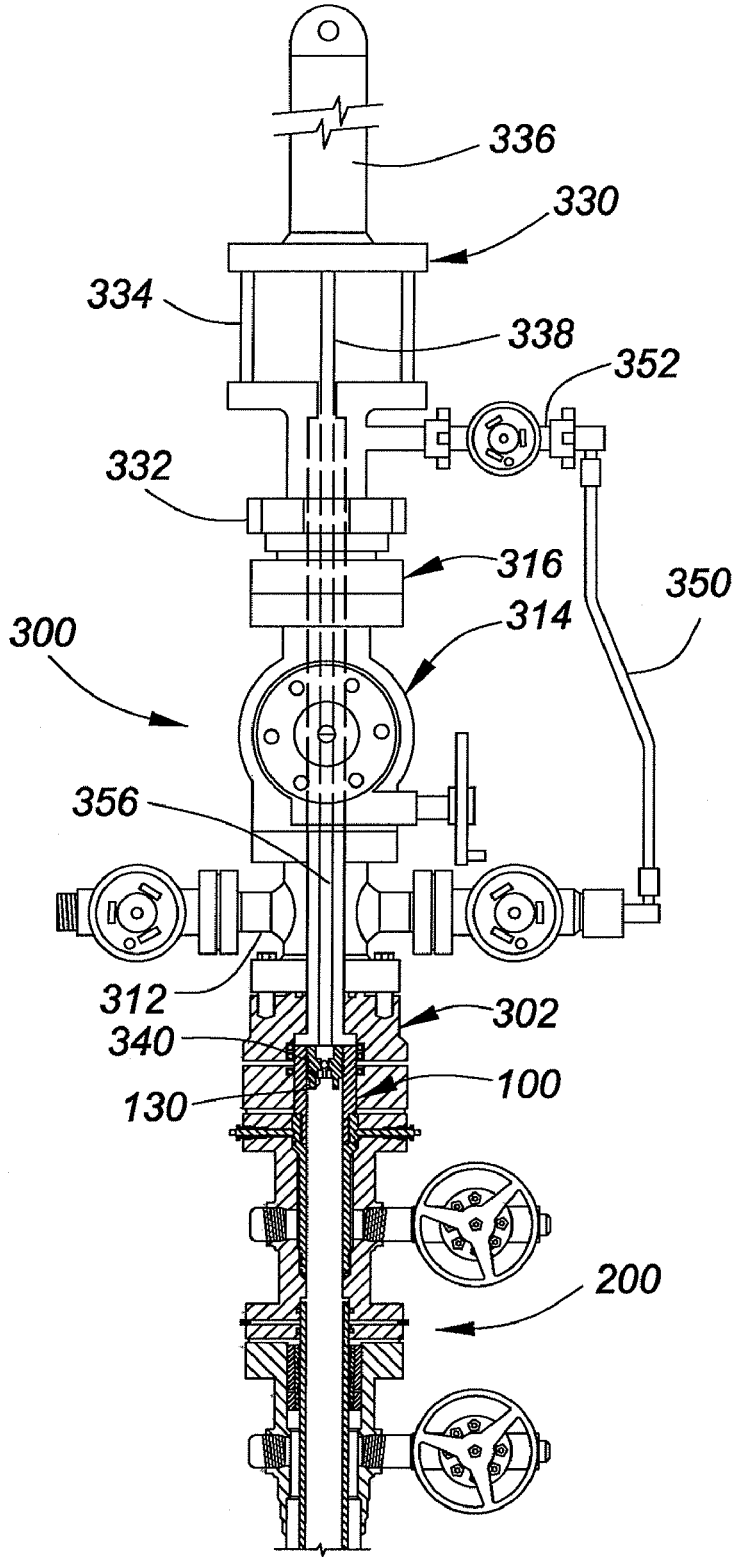
FIG. 12 is a schematic diagram of the frac mandrel shown in FIG. 9 with the back pressure plug in a set condition.
Figure 13:
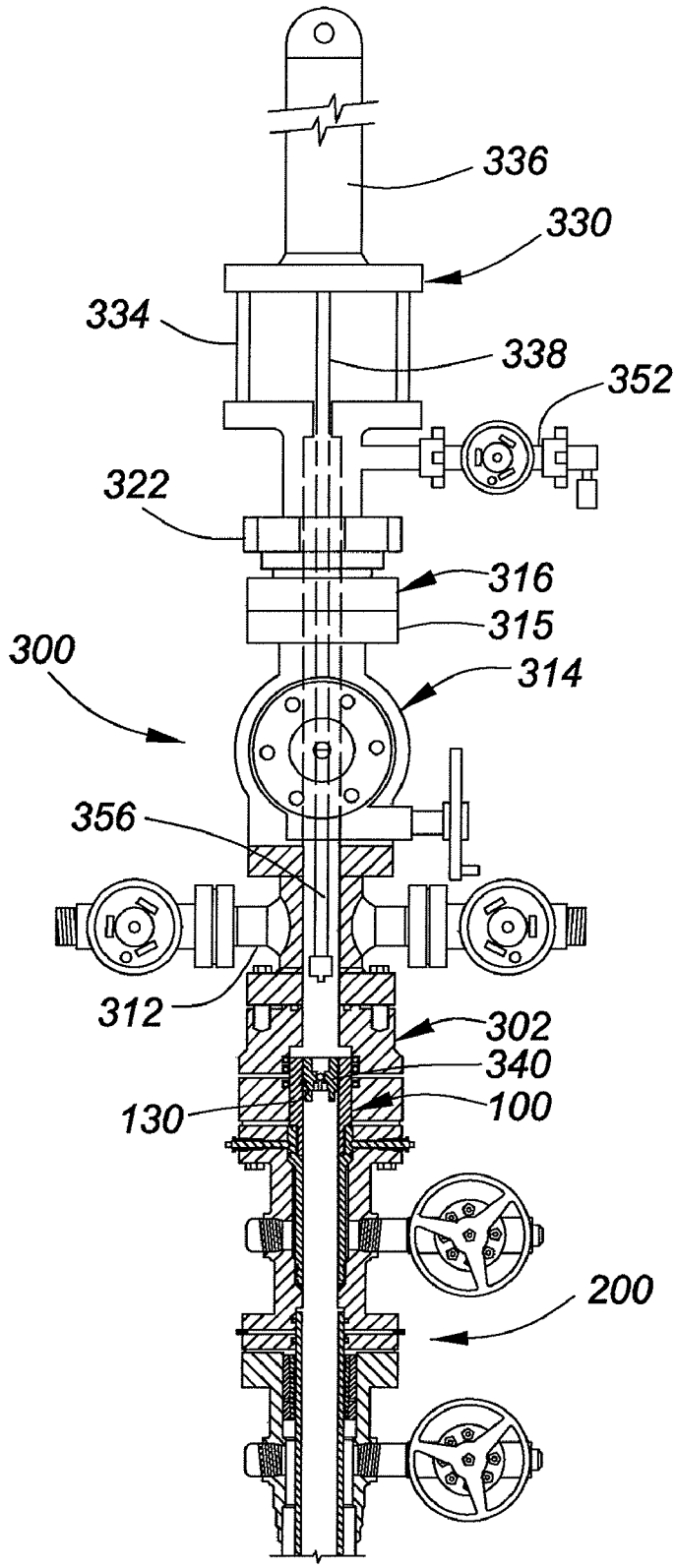
FIG. 13 is a schematic diagram of the frac mandrel and the well control stack shown in FIG. 12 with a back pressure plug setting tool disengaged from the back pressure plug.

FIG. 12 is a schematic diagram of the back pressure plug 340 after it has been stroked through the well control stack 300 and secured by the back pressure threads 130. As is well understood in the art, the back pressure threads 130 are right-handed threads, whereas the back pressure plug tool adapter 356 engages the back pressure plug 340 with a left-handed thread. Consequently, once the back pressure plug 340 is firmly engaged with the back pressure plug threads 130, the back pressure plug tool adapter 356 can be further rotated to release it from the back pressure plug 340 as shown in FIG. 13. The back pressure plug setting tool 330 is then removed from the well control stack 300 by releasing the hammer nut 322 after the back pressure plug tool adapter 356 is stroked up through the high-pressure valve 314, a fluid path through the well control stack 300 is closed by closing the high-pressure valve 314, and pressure is bled off through the pressure balance port 352.

Figure 14:
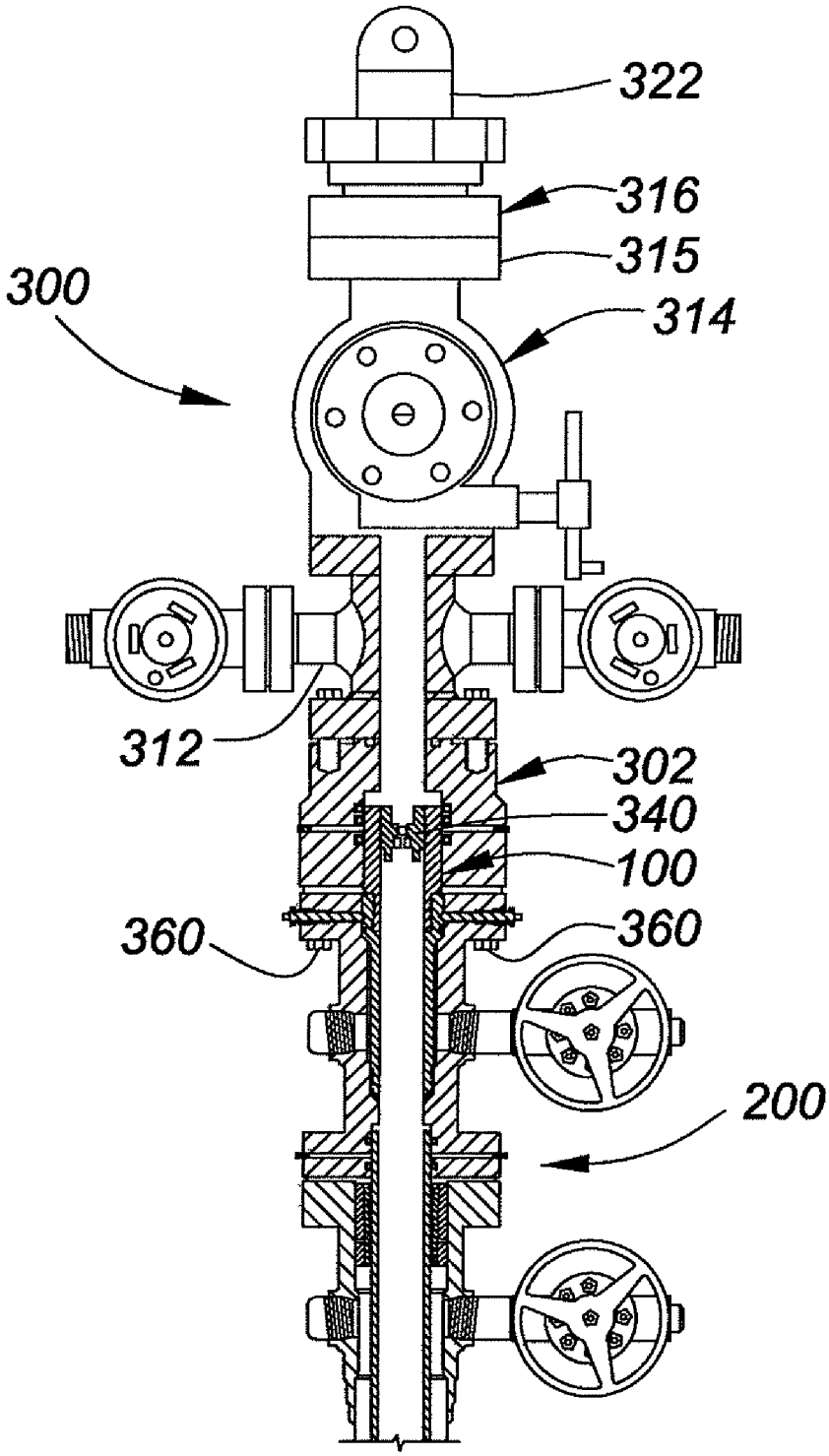
FIG. 14 is a schematic diagram of the well control stack with the backpressure plug setting tool removed and a lifting sub connected to a top of the well control stack.
Figure 15:
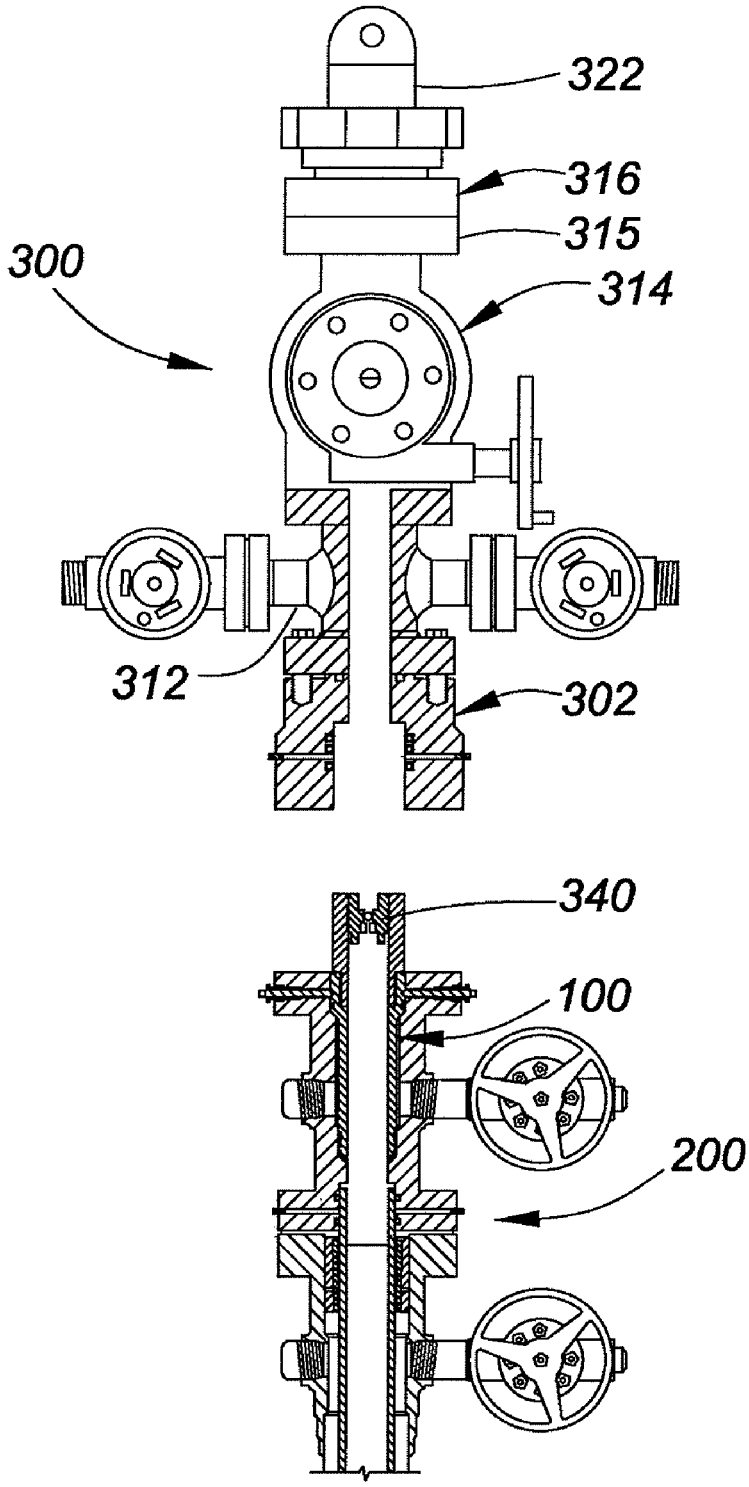
FIG. 15 is a schematic diagram of the well control stack removed from the wellhead shown in FIG. 2.

As shown in FIG. 14, the lifting sub 322 is then connected to the threaded union adapter 316 and the well control stack 300 is removed from the wellhead 200 after studs 360 are removed. FIG. 15 shows the well control stack 300 being hoisted away from the wellhead 200 using the lifting sub 322.

Figure 16:
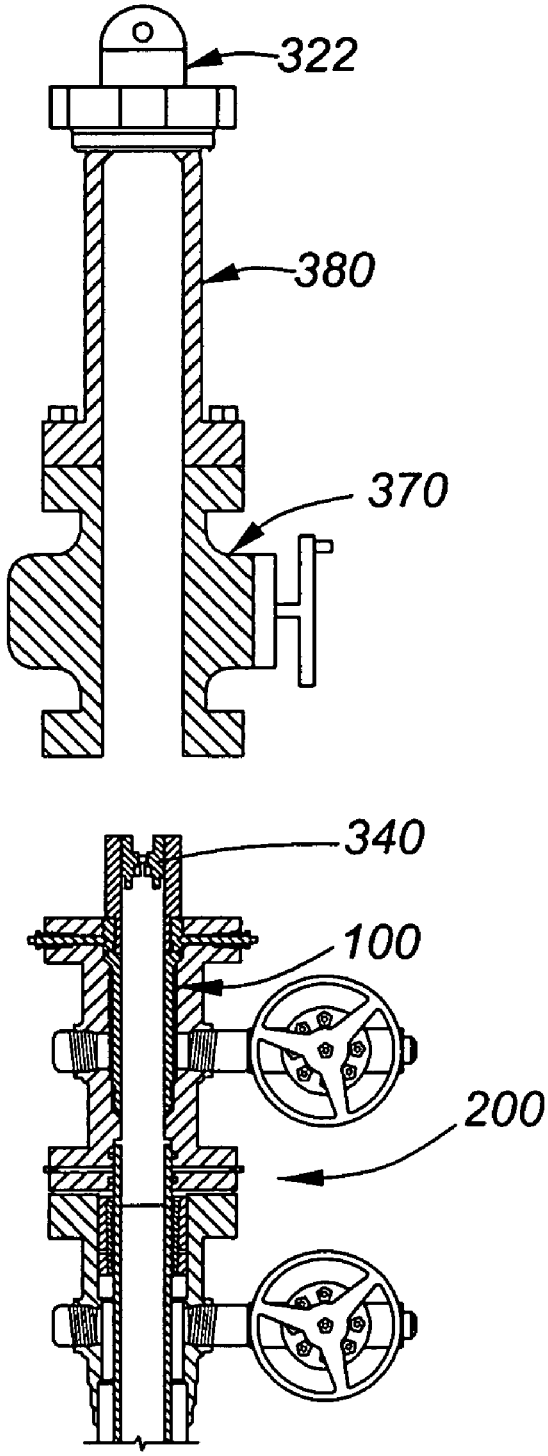
FIG. 16 is a schematic diagram of a master valve with a lubricator tube being hoisted onto the wellhead in order to remove the frac mandrel from the wellhead.

FIG. 16 shows the lifting sub 322 been used to mount a master valve a 370 and a lubricator tube 380 to the wellhead 200 after the well control stack 300 has been removed as shown in FIG. 15.

Figure 17:
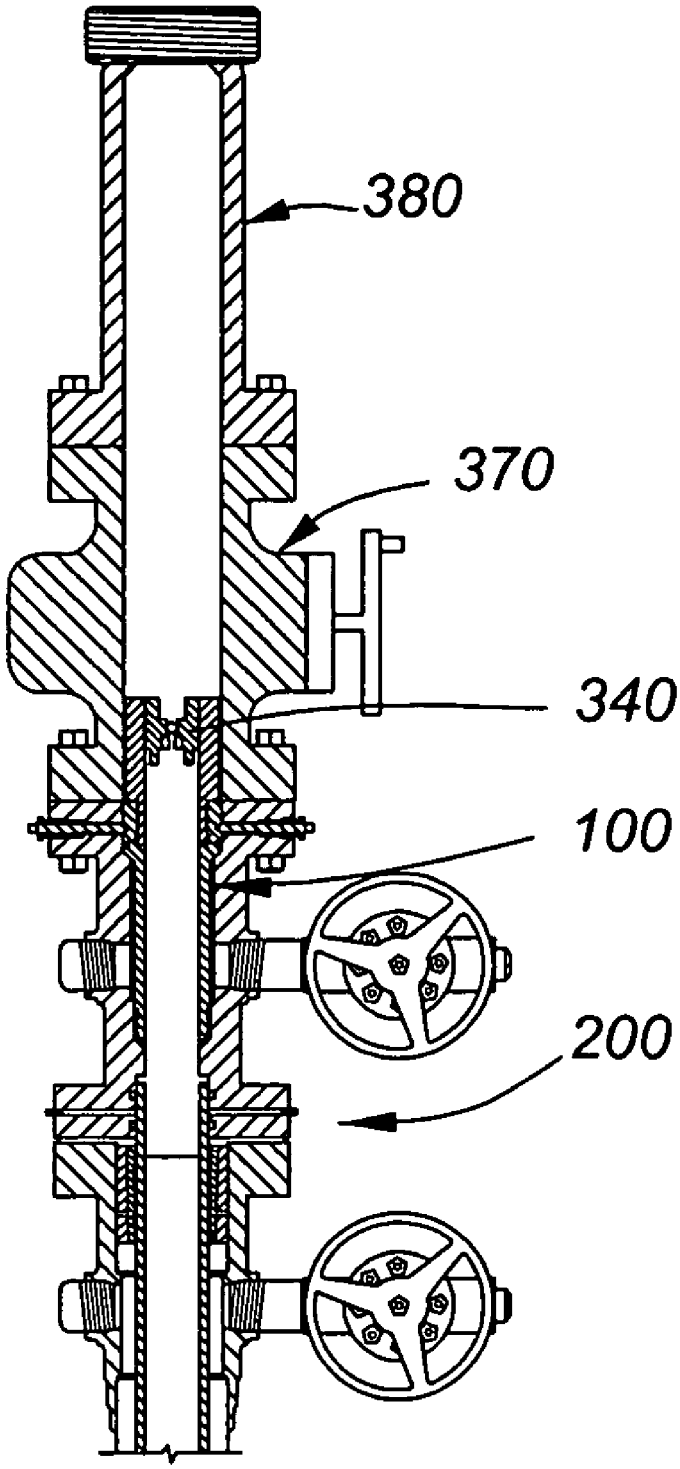
FIG. 17 is a schematic diagram of the master valve and the lubricator tube mounted to a top of the wellhead.
Figure 18:
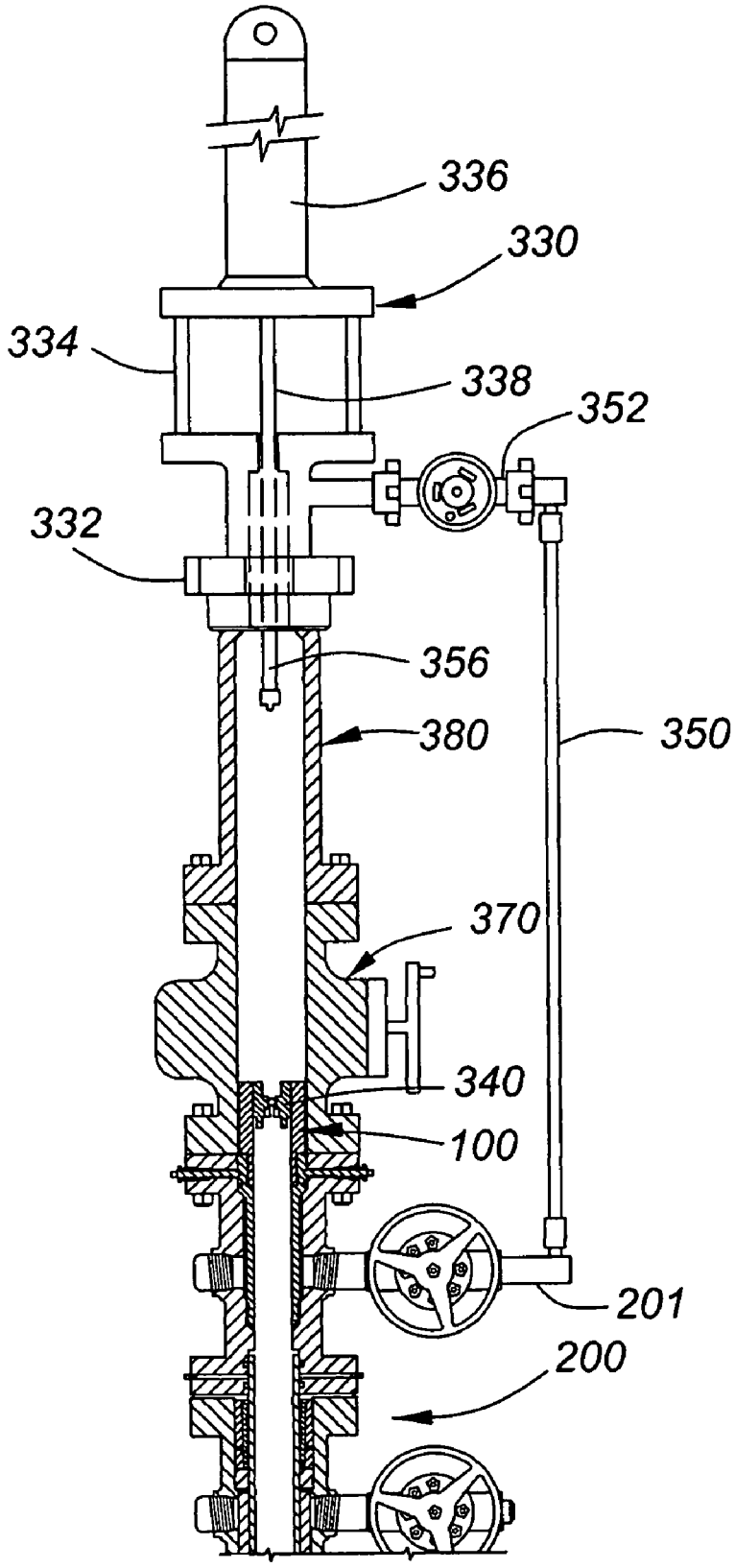
FIG. 18 is a schematic diagram of the back pressure plug setting tool mounted to a top of the lubricator tube shown in FIG. 17.

The wellhead 200 with the master valve 370 and lubricator tube 380 mounted thereto is shown in FIG. 17. The back pressure plug setting tool 330 is then mounted to a top of the lubricator tube 380 using the hammer nut 332, and the back pressure plug tool adapter 356 is stroked through the lubricator tube 380 and the master valve 370 and connected to the back pressure plug 340 as shown in FIG. 19.

Figure 19:
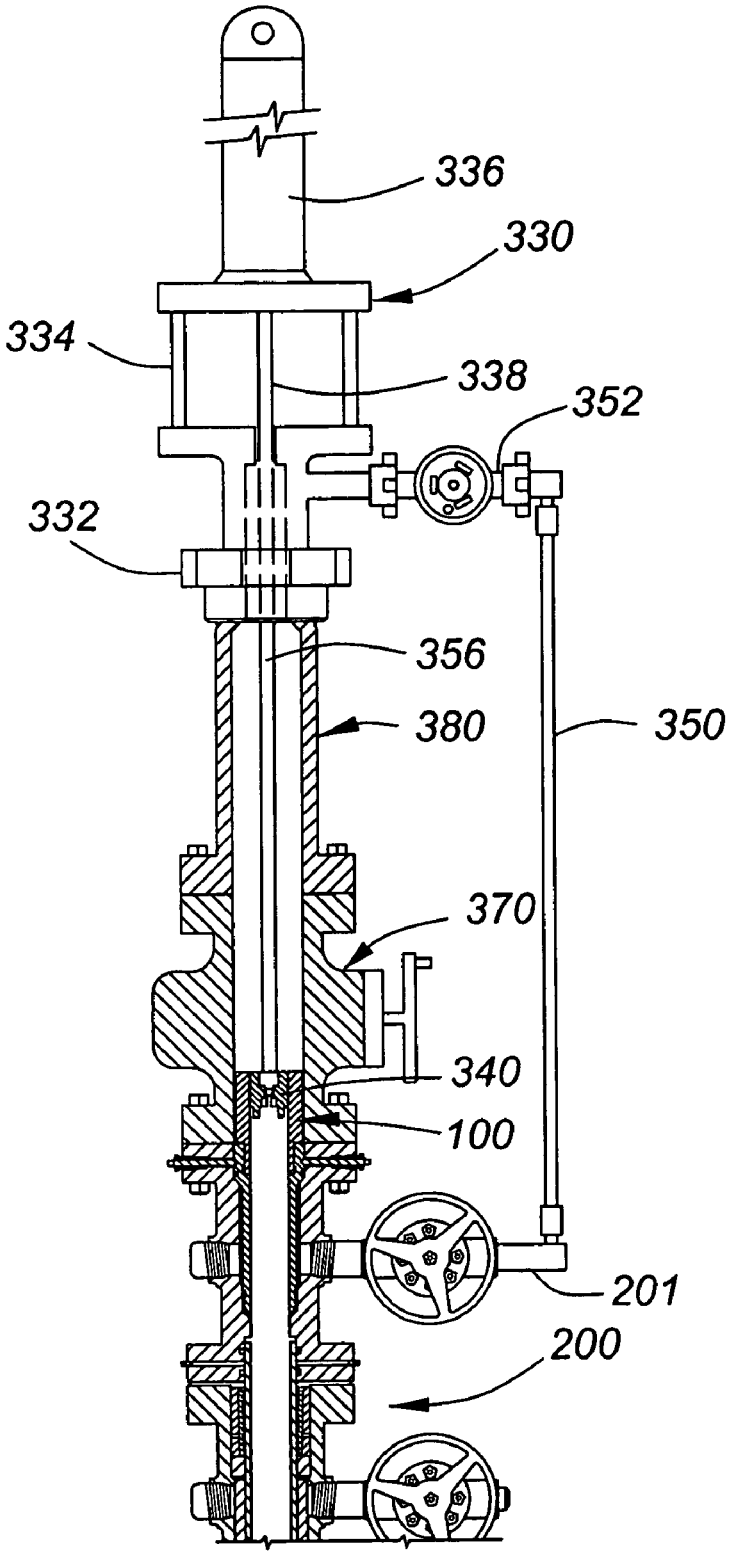
FIG. 19 is a schematic diagram of the back pressure plug setting tool connected to the back pressure plug in order to retrieve the frac mandrel from the wellhead.
Figure 20:
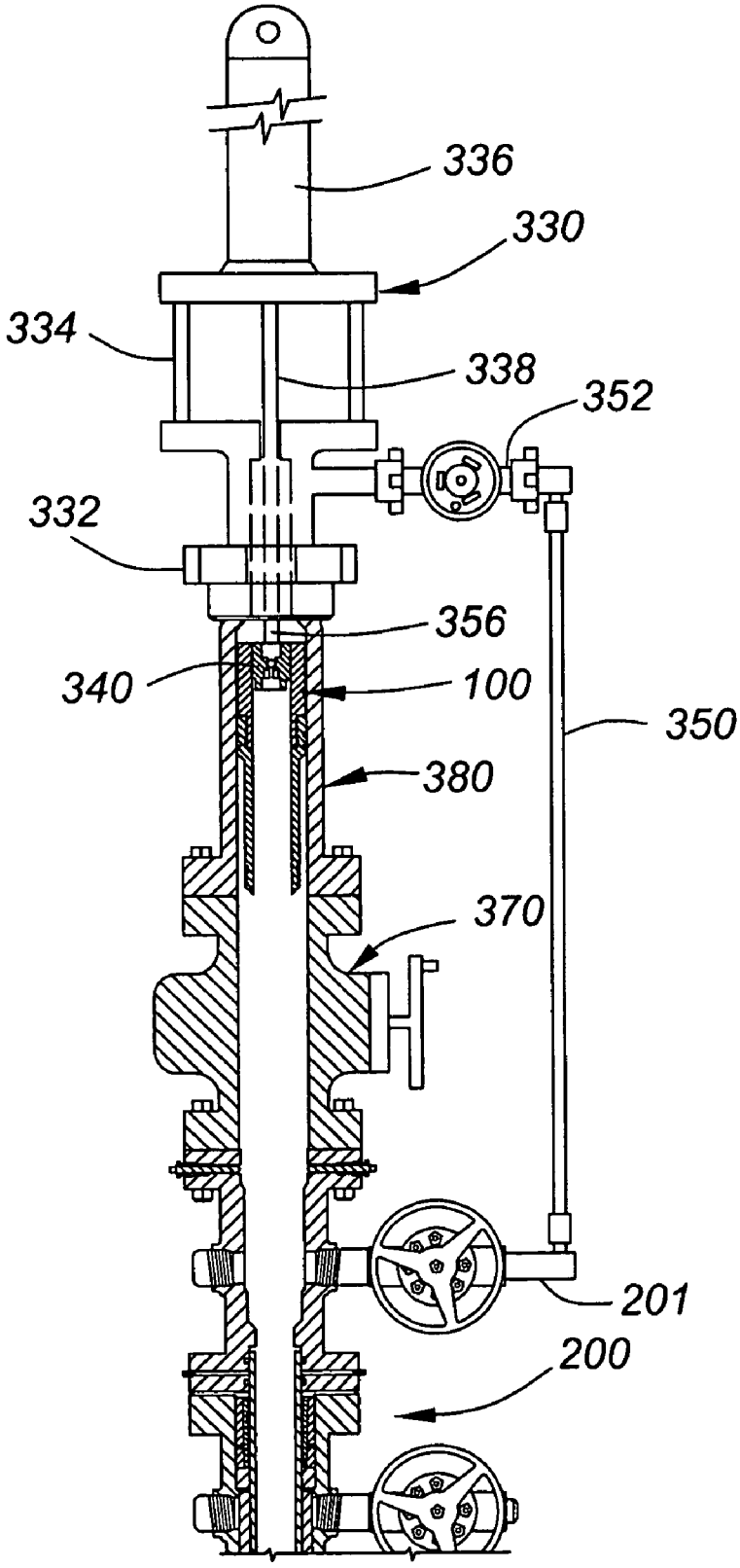
FIG. 20 is a schematic diagram of the frac mandrel drawn into the lubricator tube.
Figure 21:
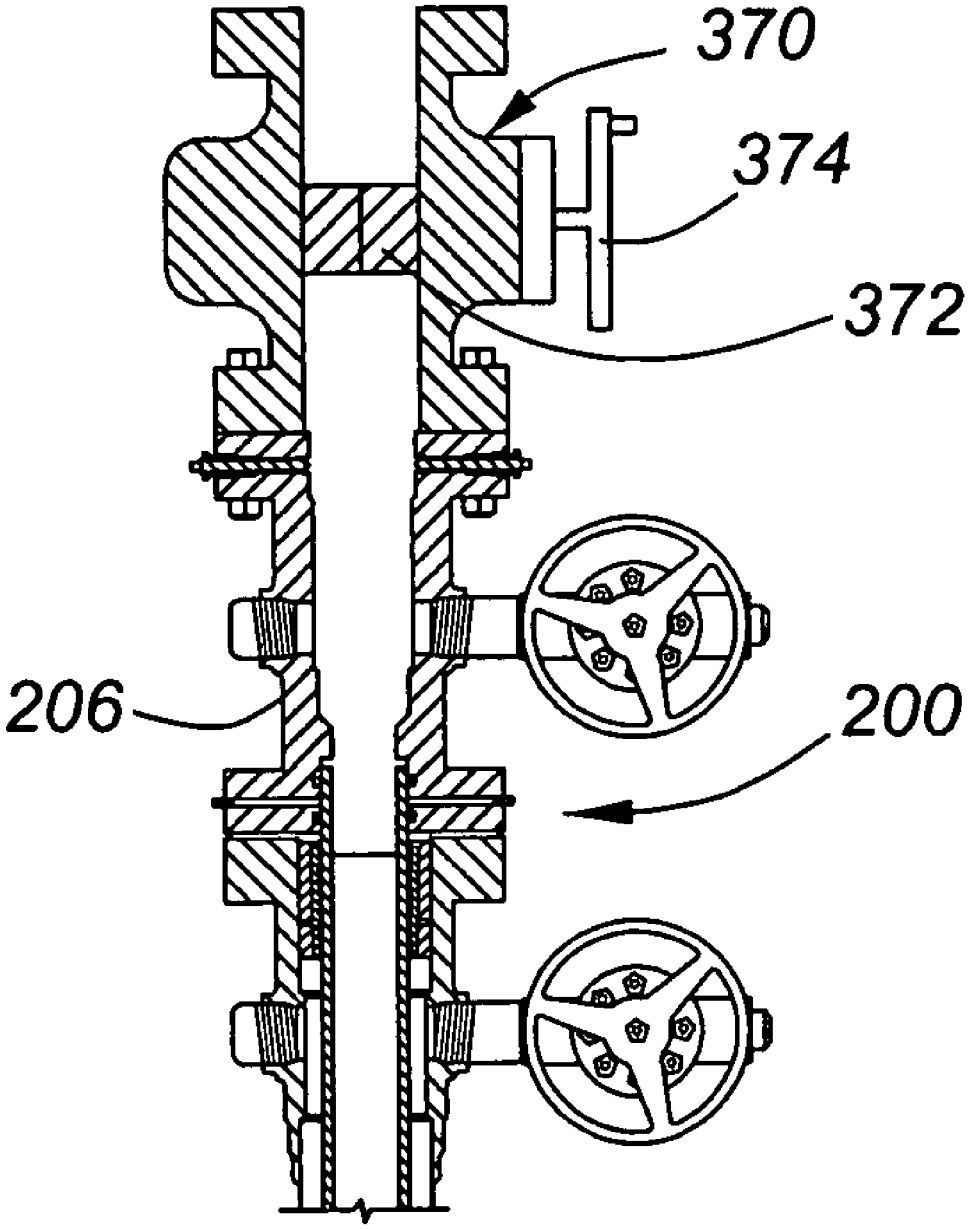
FIG. 21 is a schematic diagram of the master valve in a closed condition with the wellhead ready to be equipped for production.

Well pressure is then balanced across the frac mandrel 100 using a high-pressure line connected between the side port 201 and the pressure balance port 352, as shown in FIG. 19. The hydraulic cylinder 336 of the back pressure plug setting tool 330 is then operated to pull the frac mandrel 100 up into the lubricator tube 380 as shown in FIG. 20. Once the frac mandrel 100 is drawn up into lubricator tube 380, the master valve 370 is closed to control the well, the high-pressure line 350 is disconnected and pressure is bled off through the pressure balance port 352 to permit the lubricator tube 380 to be disconnected from the master valve 370. The lubricator tube 380 and the back pressure plug setting tool 330 are then removed from the master valve 370 and the well is ready to be prepared for production. Depending on the type of the hydrocarbon formation(s) with which the well communicates, a production tubing may be run into the well and suspended in the well using a tubing hanger (not shown) supported by the tubing head spool 206. Alternatively, a production tree may be connected directly to a top of the master valve 370 and a gate 372 of the master valve 370 opened using a valve control wheel 374, shown in FIG. 21.

As will be understood by those skilled in the art, the frac mandrels 100, 100*b* or 100*c*, in combination with the well control stack 300, provide a versatile and inexpensive system for well completion, re-completion or workover. The frac mandrel 100, 100*b* or 100*c* and the well control stack 300 can be installed and left on a wellhead for as long as required to perform a completion, re-completion or workover of the well. Operation scheduling therefore becomes less critical, delays are less costly and labor costs are reduced.

As will be further understood by those skilled in the art, the frac mandrel and well control stack in accordance with the invention enables full control of the well, while permitting equipment required for well completion, re-completion or workover to be readily and safely mounted to, or removed from, the wellhead. Since the frac mandrel and well control stack in accordance with the invention provides full-bore access to the production casing of the well, there is no restriction on the size or type of downhole tool that can be used during well completion, re-completion or workover operations.

While various alternative constructions of the frac mandrel of the system in accordance with the invention have been described, it should be understood that the embodiments described above are exemplary only.

The scope of the invention is therefore intended to be limited solely by the scope of the appended claims.

I claim:

1. A retrievable frac mandrel and well control stack for facilitating completion, re-completion or workover of a cased well having a wellhead with a tubing head spool, comprising:

the frac mandrel having a top end and a bottom end that are separate pieces interconnected by a threaded connection with a fluid seal to prevent a migration of stimulation fluids between the separate pieces, the bottom end being contoured to be received in the tubing head spool and to be locked in the tubing head spool by tubing head spool lock down screws that engage an annular groove in the bottom end, and to further provide a high-pressure fluid seal with a seal bore located above a bit guide of the tubing head spool;

a well control adapter that mounts to a top flange of the tubing head spool, the well control adapter including an axial seal bore that receives the top end of the frac mandrel to provide a high-pressure fluid seal around a periphery of the top end, and an axial passage that has a diameter smaller than an outer diameter of the top end of the frac mandrel but at least as large as an internal diameter of the frac mandrel; and flow control equipment mounted to a top flange of the well control adapter.

2. The retrievable frac mandrel and well control stack as claimed in claim 1 wherein the high-pressure fluid seal with the axial seal bore located above the bit guide of the tubing head spool comprises a plurality of O-ring grooves in a periphery of the bottom end of the frac mandrel, each of the O-ring grooves receiving a high-pressure O-ring that seals against the seal bore.

3. The retrievable frac mandrel and well control stack as claimed in claim 2 wherein the bottom end of the frac mandrel further comprises a bevel that matches a bevel angle of the bit guide, and the bevel includes an O-ring groove that receives an O-ring which seals against the bit guide.

4. The retrievable frac mandrel and well control stack as claimed in claim 1 wherein the bottom end of the frac mandrel further comprises an O-ring groove located below the annular groove, and an O-ring received in the O-ring groove that seals against a secondary seal bore in the tubing head spool.

5. The retrievable frac mandrel and well control stack as claimed in claim 1 wherein the axial seal bore comprises O-ring grooves that receive O-rings to provide the high-pressure fluid seal around the periphery of the top end of the frac mandrel.

6. The retrievable frac mandrel and well control stack as claimed in claim 1 wherein O-ring seals provide the fluid seal between the separate pieces.

7. The retrievable frac mandrel and well control stack as claimed in claim 1 wherein the flow control equipment comprises a cross-flow tee and a high pressure valve.

8. The retrievable frac mandrel and well control stack as claimed in claim 1 wherein the frac mandrel further comprises one selected from the group consisting of: backpressure plug threads for the connection of a backpressure plug to provide a high-pressure seal in a central passage through the frac mandrel; an annular groove engaged by a hydraulic shear-off tubing plug to provide the high-pressure seal in the central passage through the frac mandrel; and, a smooth internal passage that is gripped by a through-tubing plug to provide the high-pressure seal in the central passage through the frac mandrel.

9. A method of performing a completion, re-completion or workover of a cased well having a wellhead with a tubing head spool, comprising:

inserting a bottom end of a frac mandrel into the tubing head spool and locking the bottom end of the frac mandrel in the tubing head spool, the fac mandrel having a top connected to the bottom end by a threaded connection with a fluid seal to prevent a migration of stimulation fluids between the bottom end and the top end;

mounting a well control stack to a top flange of the tubing head spool, the well control stack including a well control adapter with an axial seal bore that receives the top end of the frac mandrel to provide a high-pressure fluid seal around a periphery of the top end, and an axial passage that has a diameter smaller than an outer diameter of the top end of the frac mandrel but at least as large as an internal diameter of the frac mandrel;

mounting well completion, re-completion or workover equipment to a top of the well control stack; and performing a well completion, re-completion or workover operation using the equipment.

10. The method as claimed in claim 9 further comprising:

closing a fluid path through the well control stack;

removing the well completion, re-completion or workover equipment from the top of the well control stack;

mounting a frac head to the well control stack;

opening the fluid path through the well control stack; and pumping high-pressure well stimulation fluids through the well control stack and the frac mandrel into the cased well.

11. The method as claimed in claim 10 further comprising:

flowing back the high-pressure well stimulation fluids;

closing the fluid path through the well control stack;

bleeding off fluid pressure from the well control stack; and removing the frac head from the well control stack.

12. The method as claimed in claim 11 further comprising;

mounting a backpressure plug insertion tool to the top of the well control stack;

pressure balancing well pressure across the closed fluid path through the well control stack;

opening the fluid path through the well control stack;

stroking a plug through the well control stack using the backpressure plug insertion tool;

inserting the plug into the frac mandrel to provide a high pressure fluid seal in a central passage through the frac mandrel;

releasing fluid pressure from the well control stack;

removing the backpressure plug insertion tool from the well control stack; and removing the well control stack from the tubing head spool.

13. The method as claimed in claim 12 further comprising:

mounting a lubricator tube and a master valve to a top of the tubing head spool;

mounting the backpressure plug insertion tool to a top of the lubricator tube;

stroking a plug adapter down through the lubricator tube and master valve and connecting the plug adapter to the plug in the frac mandrel;

releasing the frac mandrel from the tubing head spool; and pulling the frac mandrel up into the lubricator tube.

14. The method as claimed in claim 13 further comprising:

closing the master valve;

releasing fluid pressure from the lubricator tube; and removing the lubricator tube, the backpressure plug insertion tool and the frac mandrel from the master valve.

15. A retrievable frac mandrel for facilitating well completion, re-completion or workover of a cased well equipped with a wellhead with a tubing head spool, comprising:

a bottom end contoured to be received in a central passage of the tubing head spool, the bottom end including a plurality of O-ring grooves with high pressure O-rings that seal off against a seal bore above a bit guide of the tubing head spool, and an annular groove engaged by lockdown screws of the tubing head spool to lock the frac mandrel in the tubing head spool;

a top end threadedly connected to the bottom end with a fluid seal to prevent a migration of stimulation fluids between the top end and the bottom end; and a well control adapter that mounts to a top flange of the tubing head spool, the well control adapter including an axial seal bore that receives the top end of the frac mandrel to provide a high-pressure fluid seal around a periphery of the top end, and an axial passage that has a diameter smaller than an outer diameter of the top end of the frac mandrel but at least as large as an internal diameter of the frac mandrel.

16. The frac mandrel as claimed in claim 15 wherein the top end further comprises an internal passage with backpressure plug threads for receiving a backpressure plug for providing a high-pressure fluid seal for blocking the internal passage, and for providing an attachment point for retrieving the frac mandrel from the tubing head spool after the well completion, re-completion or workover is completed.

17. The frac mandrel as claimed in claim 15 wherein the top end further comprises an internal passage with an annular groove engaged by a hydraulic shear-off plug for providing a high-pressure fluid seal for blocking the internal passage, and for providing an attachment point for retrieving the frac mandrel from the tubing head spool after the well completion, re-completion or workover is completed.

18. The frac mandrel as claimed in claim 15 further comprising O-ring grooves with high-pressure O-rings located adjacent the threaded connection between the top and bottom ends to provide the fluid seal between the top and bottom ends.

19. The frac mandrel as claimed in claim 15 wherein the bottom end further comprises a bevel that matches a bevel angle of the bit guide, the bevel including an O-ring groove with a high-pressure O-ring that seals against the bit guide of the tubing head spool.

* * * * *